United States Patent [19]

Tuckey

[11] Patent Number: 5,038,741

[45] Date of Patent: Aug. 13, 1991

[54] IN-TANK FUEL MODULE

[75] Inventor: Charles H. Tuckey, Cass City, Mich.

[73] Assignee: Walbro Corporation, Cass City, Mich.

[21] Appl. No.: 508,427

[22] Filed: Apr. 13, 1990

[51] Int. Cl.[5] ..... F02M 37/04

[52] U.S. Cl. ..... 123/509; 123/514; 123/497; 417/360; 137/576

[58] Field of Search ..... 123/509, 510, 514, 516, 123/497, 499, 41.31; 417/363, 360, 40; 137/565, 576, 590

[56] References Cited

U.S. PATENT DOCUMENTS

| | | | |
|---|---|---|---|
| 2,084,605 | 6/1937 | Webb | 123/497 |
| 2,470,709 | 5/1949 | MacMillian | 123/357 |
| 2,926,695 | 3/1960 | Thomas | 137/576 |
| 4,181,472 | 1/1980 | Sharp | 417/363 |
| 4,231,719 | 11/1980 | Ringwald | 417/360 |
| 4,569,637 | 2/1986 | Tuckey | 417/360 |
| 4,651,701 | 3/1987 | Weaver | 123/497 |
| 4,672,937 | 6/1987 | Fales | 123/514 |
| 4,706,707 | 11/1987 | Betterton | 137/558 |
| 4,747,388 | 5/1988 | Tuckey . | |
| 4,776,315 | 10/1988 | Greiner | 123/198 D |
| 4,780,063 | 10/1988 | Tuckey | 417/360 |
| 4,795,320 | 1/1989 | Tuckey | 417/360 |
| 4,807,582 | 2/1989 | Tuckey . | |
| 4,833,899 | 5/1989 | Tugal | 417/363 |
| 4,869,225 | 9/1989 | Nagata | 123/516 |
| 4,945,884 | 8/1990 | Goha | 123/509 |
| 4,951,636 | 8/1990 | Tuckey | 123/497 |

*Primary Examiner*—Carl Stuart Miller

*Attorney, Agent, or Firm*—Barnes, Kisselle, Raisch, Choate, Whittemore & Hulbert

[57] ABSTRACT

An in-tank fuel module adapted to be mounted within a fuel tank of predetermined vertical dimension through a circular opening in an upper wall of the tank. The module includes a canister having a one-piece hollow cylindrical external wall of blow-molded plastic construction and of diameter to fit through the tank wall opening. Circumferential convolutions that extend around the wall form axially resilient bellows in the canister wall, and a fuel inlet is disposed at the lower portion of the canister. A cover is fastened to the upper edge of the canister, and is dimension to close the opening in the tank top wall with the canister extending vertically through the tank. The canister is axially dimensioned with respect to the vertical dimension of the tank so that the bellows in the canister sidewall are axially compressed and resiliently hold the lower portion of the canister against the bottom wall of the tank. A fuel pump is mounted within the canister and provides fuel under pressure through a fuel line that extends through the module cover.

12 Claims, 2 Drawing Sheets

IN-TANK FUEL MODULE

The present invention is directed to fuel delivery systems for automotive engine and like applications, and more particularly to a fuel pump module that includes an electric-motor fuel pump mounted within an in-tank reservoir.

U.S. Pat. No. 4,747,388 discloses a fuel delivery system for automotive vehicles that includes a fuel canister positioned within a fuel tank and containing an electric-motor fuel pump. The canister has a lower end positioned at the bottom of the tank with an inlet for admitting fuel from the surrounding tank. A cap or cover is slidably mounted to the upper portion of the canister. The pump draws fuel from the surrounding tank and provides fuel under pressure through fuel lines that extend through the cap to an engine located remotely of the fuel tank.

The cap and canister are of cylindrical outline, and are adapted to be received through a circular opening in the upper wall of a fuel tank. The canister extends vertically through the tank to the tank bottom, and a flange on the cover sealingly engages and closes the tank opening. The canister is held by gravity against the bottom of the tank, with sliding engagement between the canister and cover accommodating manufacturing variations in tank height. The canister is of hollow molded plastic construction and include indentations along the sidewall for receiving an electronic fuel level sensor. See also U.S. Pat. No. 4,807,582.

Although the in-tank fuel modules disclosed in the noted patents have enjoyed substantial acceptance, improvements remain desirable. For example, one problem that has existed in module assemblies in the art lies in positioning the lower portion of the module against the tank bottom so that the module and fuel inlet opening will not be subject to oscillation during normal vehicle operating conditions. It has been proposed to provide a separate spring member between the cover and canister for holding the canister against the tank bottom. However, the spring arrangements heretofore proposed have entailed unwarranted additional expense and complexity in the assembly Another problem to be addressed lies in mounting the electric-motor fuel pump within the canister in such a way as to dampen pump vibrations, which can cause undesirable noise audible in the cabin of the vehicle.

It is therefore a general object of the present invention to provide an in-tank fuel module assembly that addresses and overcomes the aforementioned deficiencies in modules of a similar character heretofore proposed in the art. Another and more specific object of the invention is to provide a fuel module of the subject character that contains a spring mechanism integral with the canister for holding the lower portion of the canister against the fuel tank bottom without requiring additional parts or assembly cost A further object of the invention is to provide a fuel module of the described character that includes facility for mounting the fuel pump within the canister so as to improve vibration isolation of the fuel pump from the canister and surrounding vehicle. Yet another object of the invention is to provide a fuel module of the subject character in which the pump control electronics and/or fuel level sensing electronics are included in the assembly and mounted in such a way as to be cooled by fuel pumped from the tank to the engine.

An in-tank fuel module of the present invention includes a canister having an external contour to be received through an opening in the upper wall of a fuel tank and to extend vertically through the tank to the tank bottom so that the fuel inlet at the lower portion of the canister is positioned adjacent to the tank bottom. A cover is coupled to the canister for closing the tank opening and mounting the canister within the tank. A fuel pump is mounted within the canister for delivering fuel under pressure through the cover. In accordance with a distinguishing feature of the invention, the canister has an external wall that includes a spring mechanism for resiliently holding the lower portion of the canister against the tank bottom.

In the preferred embodiments of the invention, the canister is of one-piece hollow blow-molded plastic construction, and the spring mechanism takes the form of bellows formed by convolutions in the canister wall that extend circumferentially around the canister. The bellows are compressed in assembly of the module to a fuel tank so as to hold the lower portion of the canister resiliently against the tank bottom. In one embodiment of the invention in which the canister is angulated vertically through the tank from top to bottom, the bellows are interrupted by longitudinal gussets on diametrically opposed sides of the canister wall extending axially through the bellows for limiting the direction of bending of the canister wall with respect to the canister-mounting cover.

The fuel pump is mounted by springs to an inwardly extending ledge formed integrally with the canister wall. These mounting springs, coupled with the inherent vibration-damping construction of the plastic canister wall, greatly enhance vibration isolation of the pump. A fuel level sensor is removably received by snap fit in a depression or pocket of suitable geometry integrally molded into the canister wall. The pump control electronics, and any electronics associated with the fuel level sensor, are mounted on a printed circuitboard within the cover at a position adjacent to a portion of the fuel line from the pump so that fuel flowing through the fuel line draws heat from and cools the electronics.

The invention, together with additional objects, features and advantages thereof, will be best understood from the following description, the appended claims and the accompanying drawings in which:

Figure 1:
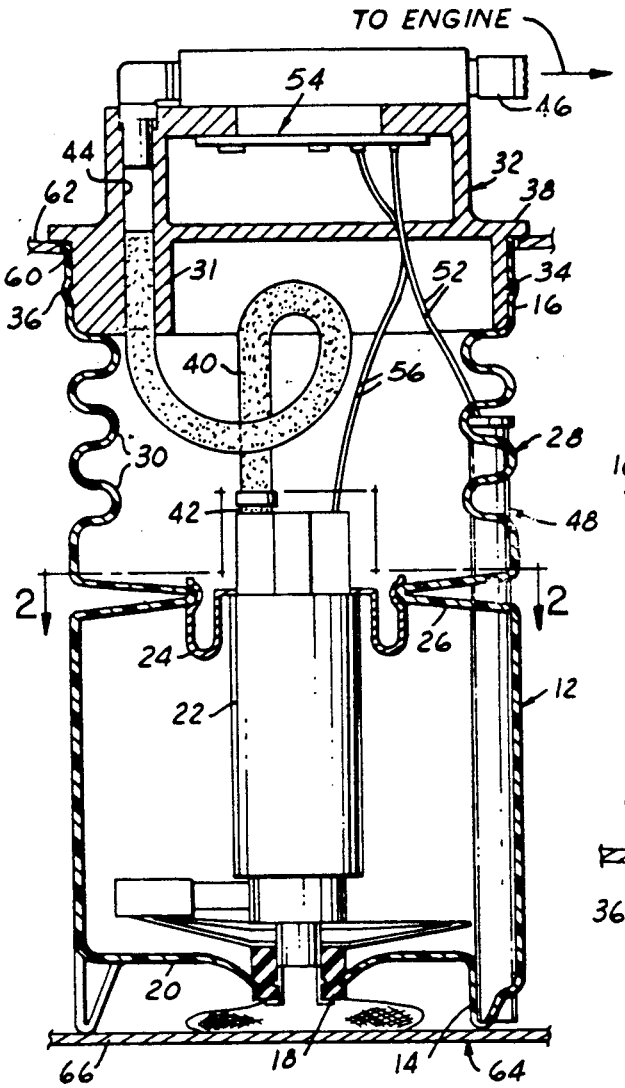
FIG. 1 is a fragmentary sectional view in side elevation of a fuel delivery module in accordance with one presently preferred embodiment of the invention.
Figure 2:
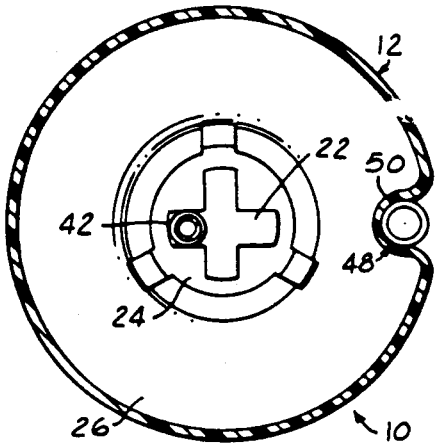
FIG. 2 is a sectional view taken substantially along the line 2—2 in FIG. 1.

FIGS. 1-2 illustrate a fuel delivery module 10 in accordance with one presently preferred embodiment of the invention as comprising a generally cylindrical canister 12 having a lower end 14 and an upper end 16. A bushing 18 is mounted in a wall 20 at the lower end of canister 12 to form a fuel inlet to an electric-motor fuel pump 22. Fuel pump 22 is mounted within canister 12 by bushing 18 and by a three-legged spring 24. Spring 24 embraces the upper end of pump 22 and has arcuate legs captured within a circumferential ledge 26 that extends inwardly from the wall of canister 12 integrally therewith.

Bellows 28 are formed by three radially inwardly projecting convolutions 30 that extend circumferentially around an upper portion of the canister wall between ledge 26, which is approximately centered axially of the canister, and canister upper end 16. A depending flange 31 on a cover 32 of aluminum or other suitable heat-conductive construction has a circumferential rib 34 that is intertnally received by snap fit in a corresponding detent 36 at the canister upper end 16 for closing the canister upper end. A flange 38 on cover 32 extends radially outwardly of the canister upper end. A fuel line 40 connects the outlet 42 of pump 22 to a passage 44 within cover 32. The distal end of passage 44 is connected by a suitable fuel line 46 to the engine or the like to which fuel is supplied.

An elongated cylindrical fuel level sensor 48 is received and held by snap fit within a pocket or depression 50 (FIG. 2) in the external surface of canister 12, and extends axially of the canister from a position adjacent to canister bottom 14. Fuel level sensor 48 in the embodiment of the invention illustrated in FIG. 2 preferably takes the form of an electronic sensor of the character disclosed in U.S. application Ser. No. 07/318,126, filed Mar. 2, 1989 and assigned to the assignee hereof. Other suitable electronic fuel level sensors may be employed. Fuel level sensor 48 is connected by suitable conductors 52 (FIG. 1) to a circuitboard assembly 54 that contains the sensor electronics. Likewise, pump 22 is connected by suitable conductors 56 to circuit assembly 54, which contains appropriate pump drive electronics. Suitable pump drive electronics are disclosed, for example, in U.S. application Ser. No. 07/421,810, filed Oct. 16, 1989 and assigned to the assignee hereof. Details of the pump drive electronics and/or fuel level sensing electronics do not, per se, form part of the present invention. Circuitboard assembly 54 is mounted within cover 32 at a position adjacent to fuel passage 44 so that heat generated by the electronics is conducted through the heat conductive construction of cover 32 and dissipated by fuel flowing through passage 44.

Canister 12, including ledge 26, bellows 28, ends 14,16, wall 20 and depression 50, is preferably formed of integral molded plastic, most preferably blow-molded plastic, construction. Canister 12 may be of acetel composition, for example, and have a thickness of 0.5 to 1.5 mm. In use, module 10 is preassembled as shown in FIGS. 1–2, with cover 32 telescopically received within and fastened to canister 12. The module assembly may be inserted through the usual circular opening 60 in the upper wall 62 of a fuel tank 64 until flange 38 rests against the upper tank wall and closes the tank opening. (Cover 32 is fastened to tank wall 621 by means not shown). Canister 12 is axially dimensioned to be slightly longer than the vertical dimension of tank 64, so that bellows 28 are axially compressed in assembly to the tank and resiliently hold lower canister end 14 against the bottom wall 66 of tank 64. The canister lower end is thus held against the tank bottom against turns and vibration in normal use of the vehicle.

Figure 3:
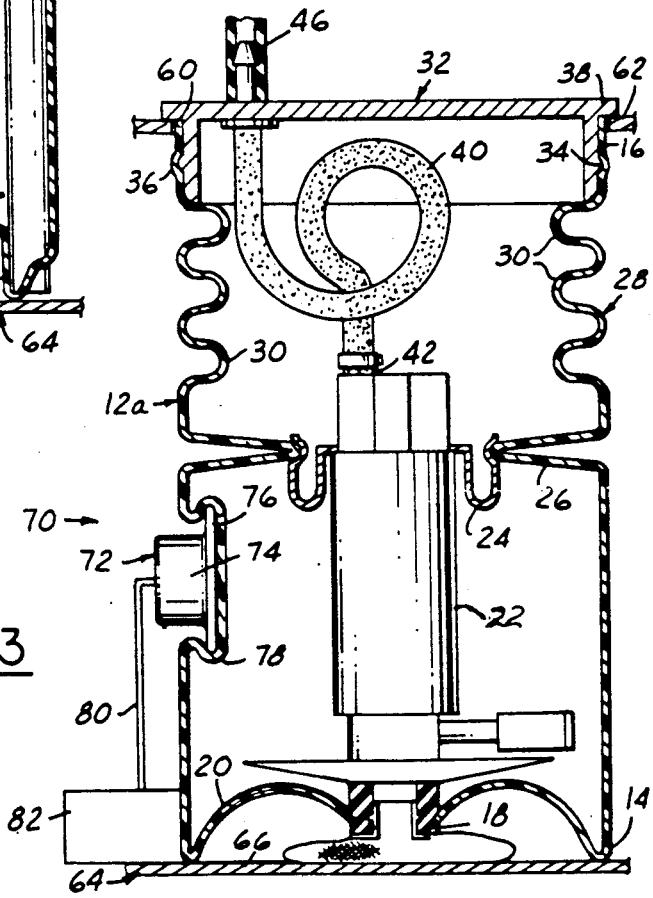
FIG. 3 is a fragmentary sectional view in side elevation of a fuel delivery module in accordance with a second embodiment of the invention.

FIG. 3 illustrates a modified fuel module 70 that includes a float-type fuel level sensor 72. Sensor 72 includes a variable resistor or the like contained within a housing 74 that has a flange 76 received by snap fit within a pocket or depression 78 in the sidewall of the canister 12*a*. An arm 80 extends from housing 74 and carries a float 82 that rises and falls with the level of fuel in surrounding tank 64. With the exception of level sensor 72, module 70 is essentially the same as that hereinabove discussed in connection with FIGS. 1–2.

Figure 5:
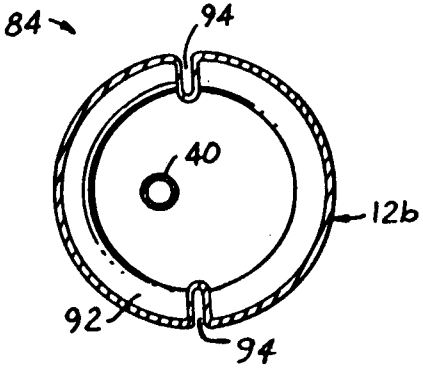
FIG. 5 is a sectional view taken substantially along the line 5—5 in FIG. 4.
Figure 4:
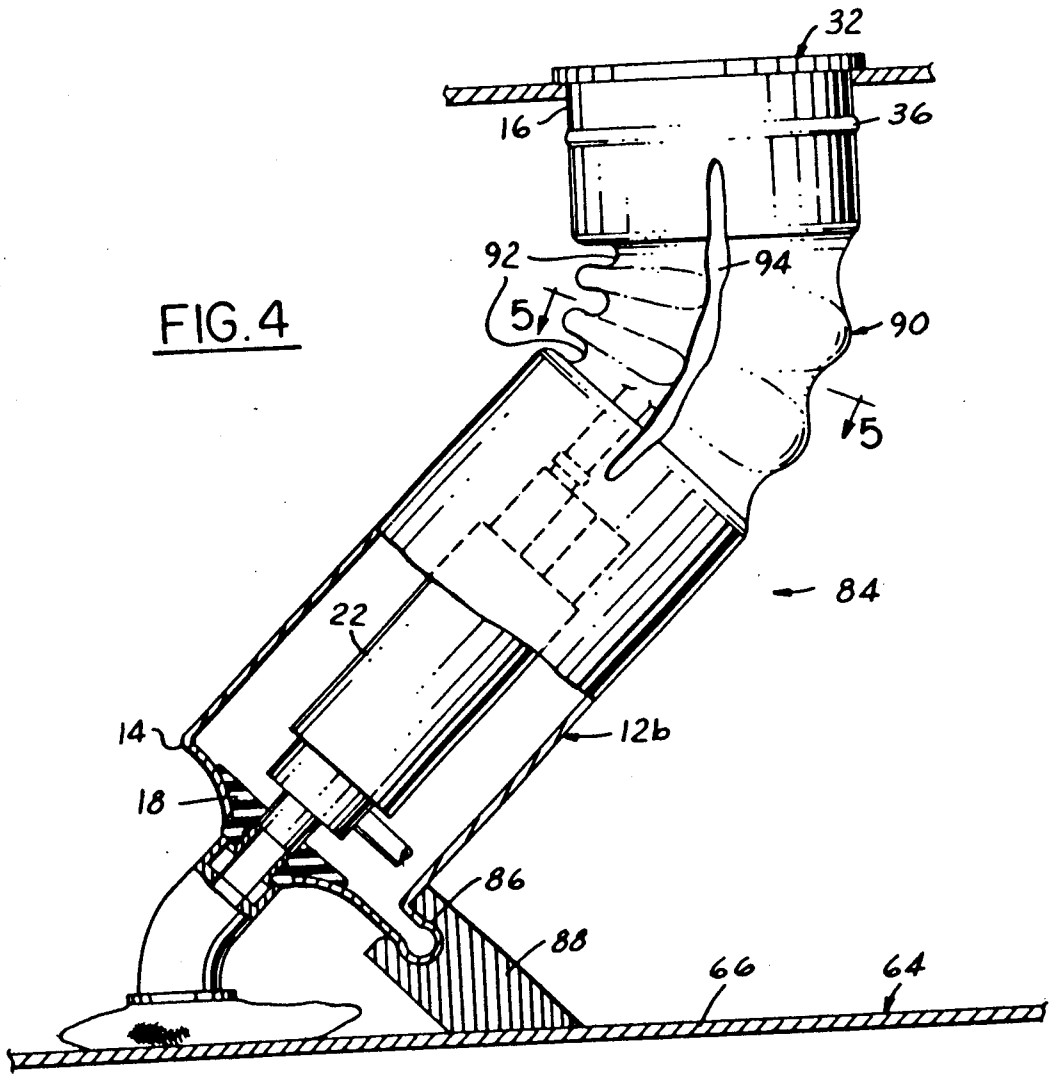
FIG. 4 is a fragmentary sectional view in side elevation of a fuel delivery module in accordance with a third embodiment of the invention.

FIGS. 4–5 illustrate another fuel module 84 in accordance with the invention. The canister 12*b* of module 84 has a lip 86 at lower end 14 that receives a stop 88 for engaging the bottom wall 66 of fuel tank 64 and holding the lower portion of the canister at an angle to the tank bottom. The circumferential convolutions 92 of bellows 90 extend around the sidewall of canister 12*b*, and are interrupted by a pair of longitudinal gussets 94 that extend axially through the convolutions on diametrically opposed sides of the canister, as best seen in FIG. 5. Gussets 94 prevent bending of bellows 90 in the lateral direction into and out of the page in FIG. 4, or up and down in FIG. 5, while permitting bending of the bellows orthogonally of such direction. The remainder of module 84 is similar to that of FIGS. 1 and 2.

I claim:

1. An in-tank fuel module for automotive engines and the like comprising:

a canister having an external contour to be received through an opening in an upper wall of a fuel tank and to extend vertically through the tank to a bottom of the tank, and a fuel inlet at a lower portion of said canister to be positioned adjacent to the tank bottom, a cover for closing the tank opening and mounting said canister within the tank, and a fuel pump mounted within said canister for delivering fuel under pressure through said cover, characterized in that said canister has an external wall and spring means in said wall for resiliently holding said lower portion of said canister against said tank bottom, said external wall including said spring means being of one-piece hollow construction.

2. An in-tank fuel module adapted to be mounted within a fuel tank of predetermined vertical dimension through a circular opening in an upper wall of the tank, said module comprising:

canister having a one-piece hollow cylindrical external wall of diameter to fit through said opening and radially inwardly projecting circumferential convolutions extending around said wall forming axially resilient bellows in said wall, and a fuel inlet adjacent at a lower portion of said canister, a cover including means fastening said cover to an upper edge of said canister wall, said cover being dimensional to close the tank wall opening with said canister extending vertically through the tank, said canister wall being axially dimensioned such that said bellows are compressed when said canister and cover are mounted in the tank resiliently to hold said lower portion of said canister against the bottom of the tank, and a fuel pump mounted within said canister with conduit means extending through said cover for delivering fuel under pressure.

3. An in-tank fuel module for automotive engines and the like comprising:

a canister having an external contour to be received through an opening in an upper wall of a fuel tank and to extend vertically through the tank to a bottom of the tank, and a fuel inlet at a lower portion of said canister to be positioned adjacent to the tank bottom, a cover for closing the tank opening and mounting said canister within the tank, and an electric motor fuel pump mounted within said canister for delivering fuel under pressure through said cover, characterized in that said canister has an external wall and spring means in said wall for resiliently holding said lower portion of said canister against said tank bottom, and in that said module further includes pump drive electronics mounted in said cover and electrically connected to said pump.

4. The fuel module set forth in claim 3 wherein said external wall including said spring means is of one-piece hollow construction.

5. The fuel module set forth in claim 1 wherein said canister wall is of cylindrical external geometry, and wherein said spring means comprises bellows in said wall extending circumferentially around said wall.

6. The fuel module set forth in claim 5 wherein said canister wall is of blow-molded plastic construction.

7. The fuel module set forth in claim 6 wherein said spring means further comprises longitudinal gussets extending axially through said bellows in diametrically opposed sides of said wall for limiting direction of bending of said wall with respect to said cover.

8. The fuel module set forth in claim 6 wherein said wall includes an integral radially inwardly extending ledge, and wherein said pump includes second spring means mounting said pump to said ledge.

9. The fuel module set forth in claim 6 further comprising a fuel level sensor and means mounting said sensor by releasable snap fit externally of said wall.

10. The fuel module set forth in claim 1 wherein said pump comprises an electric-motor fuel pump, and wherein said module further includes pump drive electronics mounted in said cover and electrically connected to said pump.

11. The fuel module set forth in claim 3 wherein said cover includes fuel conduit means for connecting said pump to an engine, and means mounting said pump drive electronics in heat transfer communication with fuel in said conduit means.

12. The fuel module set forth in claim 2 wherein said canister wall is of blow-molded plastic construction.

* * * * *